US007083533B2

(12) United States Patent
Kasahima et al.

(10) Patent No.: US 7,083,533 B2
(45) Date of Patent: Aug. 1, 2006

(54) GOLF BALL

(75) Inventors: Atsuki Kasahima, Chichibu (JP); Rinya Takesue, Chichibu (JP); Kazuto Maehara, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 289 days.

(21) Appl. No.: 10/270,491

(22) Filed: Oct. 16, 2002

(65) Prior Publication Data

US 2003/0096663 A1 May 22, 2003

(30) Foreign Application Priority Data

Oct. 26, 2001 (JP) ..... 2001-329273

(51) Int. Cl.

| | |
|---|---|
| ***A63B 37/12*** | (2006.01) |
| ***A63B 37/14*** | (2006.01) |
| ***A63B 37/04*** | (2006.01) |
| ***A63B 37/06*** | (2006.01) |

(52) U.S. Cl. ..... 473/378; 473/371

(58) Field of Classification Search ..... 473/351–383
See application file for complete search history.

(56) References Cited

U.S. PATENT DOCUMENTS

| | | | | |
|---|---|---|---|---|
| 5,145,180 | A * | 9/1992 | Oka | 473/382 |
| 5,292,132 | A * | 3/1994 | Oka | 473/384 |
| 5,779,563 | A | 7/1998 | Yamagishi et al. | |
| 5,782,707 | A | 7/1998 | Yamagishi et al. | |
| 5,846,141 | A * | 12/1998 | Morgan et al. | 473/377 |
| 5,876,294 | A | 3/1999 | Yamagishi et al. | |
| 5,902,193 | A * | 5/1999 | Shimosaka et al. | 473/384 |
| 6,213,898 | B1 * | 4/2001 | Ogg | 473/383 |
| 6,241,627 | B1 * | 6/2001 | Kasashima et al. | 473/384 |
| 6,419,594 | B1 * | 7/2002 | Nesbitt et al. | 473/371 |
| 6,520,872 | B1 * | 2/2003 | Endo et al. | 473/374 |
| 6,729,976 | B1 * | 5/2004 | Bissonnette et al. | 473/383 |

OTHER PUBLICATIONS

Farrally, M.R. et al. Science and Golf III, Illinois: Human Kinetics, copyright 1999, pp. 412-413.*

* cited by examiner

*Primary Examiner*—Stephen Blau
*Assistant Examiner*—Alvin A. Hunter, Jr.
(74) *Attorney, Agent, or Firm*—Sughrue Mion, PLLC

(57) ABSTRACT

In a golf ball comprising an elastic solid core, a mantle layer, and a resin cover having a plurality of dimples, the difference in Shore D hardness between the cover and the mantle layer is at most 10, and the dimples have a total volume of 280–350 $mm^3$. This combination of features provides the golf ball with an excellent balance of rebound, spin and feel, and an outstanding total distance.

10 Claims, 2 Drawing Sheets

GOLF BALL

BACKGROUND OF THE INVENTION

1. Field of the Invention

The present invention relates to a multi-piece solid golf ball of outstanding rebound, spin, feel and distance which has an elastic solid core enclosed within a plurality of resin layers of differing physical characteristics.

2. Prior Art

Golf balls in recent years have seen an overwhelming shift in preference take place from thread-wound constructions to solid constructions on account of the excellent distance achieved by the latter. At first, a solid construction typically referred to a two-piece solid golf ball in which the center, which represents most of the ball, is composed of a solid rubber core of excellent impact resilience and is enclosed within a hard resin cover such as one made of ionomer resin for protection from external damage.

However, although such a construction provides an excellent distance, the deformation at the time of impact is smaller than that of thread-wound balls, resulting in a hard and unpleasant feel. Also, the small deformation means that the surface area of contact with the clubface is small, giving the ball a poor spin receptivity and poor controllability on shots taken with an iron. Various attempts have been made to overcome such drawbacks, such as lowering the hardness of the solid core, placing a buffer layer between the core and the cover, and using a relatively soft polyurethane as the cover material.

Such modifications have made it possible to largely achieve the desired improvements in feel and spin rate. Yet, these improvements have been accompanied by a number of new problems, such as a decline in carry—originally a desirable attribute of solid ball constructions, due to a smaller rebound. Another new problem has been the ball's excessive receptivity to spin when hit for distance with a wood club, particularly a driver, resulting instead in a somewhat skying shot that fails to achieve the desired distance. Little progress has been made in overcoming these problems.

SUMMARY OF THE INVENTION

It is therefore an object of the invention to provide a multi-piece golf ball which is composed of a solid core enclosed within a plurality of thermoplastic resin layers, in which the relative hardnesses and absolute hardnesses of the constituent members have been adjusted so as to achieve a good balance in rebound, spin and feel, and which has been provided with an optimal dimple configuration to confer excellent distance.

The present invention relates to golf balls comprising an elastic solid core, a mantle layer, and a resin cover having a plurality of surface dimples. We have discovered that when the difference in Shore D hardness between the cover and the mantle layer is at most 10 and the dimples have a total volume of 280 to 350 $mm^3$, the golf balls are endowed with excellent rebound, spin and feel, and can also achieve increased distance.

Accordingly, the invention provides a golf ball that includes an elastic solid core, a resin cover which encloses the core and has a plurality of surface dimples, and a mantle layer situated between the core and the cover. The cover and the mantle layer have a difference in Shore D hardness therebetween of at most 10, and the dimples have a total volume of 280 to 350 $mm^3$.

The mantle layer has a Shore D hardness of preferably 56 to 68, and most preferably 56 to 66. The cover has a Shore D hardness of preferably 51 to 62, and most preferably 54 to 62.

It is advantageous for the mantle layer to be composed primarily of an ionomer resin and to contain also an olefin elastomer, and for the cover to be composed primarily of a polyurethane elastomer.

The golf ball of the invention has preferably 300 to 400 dimples of at least 3.7 mm diameter, and the dimples on the ball typically account for a surface coverage of at least 75%, based on the total surface of the ball. It is preferable that at most only one great circle which does not intersect any dimples can be traced on the golf ball.

Preferably, the elastic solid core of the golf ball undergoes a deflection of 2.8 to 4.2 mm when subjected to a load of 1,275 N (130 kgf) from an initial load of 98 N (10 kgf).

The golf ball of the invention typically has a coefficient of restitution, at an incident velocity of 43 m/s, of 0.77 to 0.83. Moreover, the inventive golf ball, when hit, typically has a coefficient of lift CL and a coefficient of drag CD such that the ratio CL/CD is 0.676 to 0.796 at a Reynolds number of 200,000 and a spin rate of 2,700 rpm, 0.813 to 0.933 at a Reynolds number of 120,000 and a spin rate of 2,400 rpm, and 0.856 to 0.976 at a Reynolds number of 80,000 and a spin rate of 2,000 rpm.

BRIEF DESCRIPTION OF THE DRAWINGS

The objects, features and advantages of the invention will become more apparent from the following detailed description, taken in conjunction with the accompanying drawings.

DETAILED DESCRIPTION OF THE INVENTION

Figure 1:
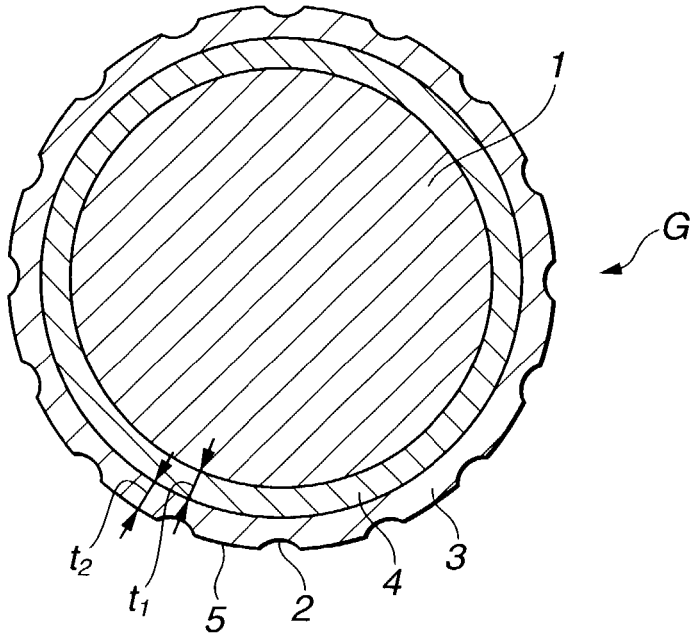
FIG. 1 is a schematic sectional view of the golf ball of the invention.

Referring to FIG. 1, the golf ball G of the invention is a multi-piece solid golf ball composed of an elastic solid core 1 covered with at least two resin layers: a cover 3 which encloses the core 1 and has a plurality of dimples 2 thereon, and a mantle layer 4 which adjoins the cover 3 on the inner side thereof.

The elastic solid core can be produced from a known material, and is preferably made of a rubber composition. The rubber composition is preferably one in which polybutadiene is used as the base rubber. 1,4-Polybutadiene having a cis structure of at least 40% is preferred. If desired, other rubbers, such as natural rubber, polyisoprene rubber or styrene-butadiene rubber may be suitably blended into the base rubber. The rebound energy of the golf ball can be improved by increasing the amount of rubber components.

Any core material known to the art may be included in the above rubber composition. Examples of suitable core materials include unsaturated carboxylic acids and/or metal salts thereof, organic peroxides and organosulfur compounds. The elastic solid core in the golf ball of the invention can be produced by subjecting the above-described rubber composition to vulcanization and curing by a known process.

To ensure a good flight performance, it is recommended that the elastic solid core have a diameter of at least 35.6 mm, and preferably at least 36.2 mm, but not more than 39.0 mm, and preferably not more than 37.0 mm.

Moreover, the elastic solid core, when subjected on a flat plate to an increase from an initial load of 98 N (10 kgf) to a load of 1,274 N (130 kgf), has a deflection in a range of preferably 2.8 to 4.2 mm. At a deflection of less than 2.8 mm, the core may be too hard, resulting in a poor feel. On the other hand, at a deflection of more than 4.2 mm, the core has a low resilience, which may give the ball an inadequate flight performance.

The mantle layer in the golf ball of the invention can be formed from a known resin material by a conventional method, although formation from a composition made primarily of an ionomer resin is recommended. The mantle layer material used in the invention may be composed solely of an ionomer resin, although it is preferably a composition prepared by the addition of an olefin elastomer to an ionomer resin.

Exemplary olefin elastomers include olefin-based block copolymers, olefin-based random copolymers, and dynamically crosslinked thermoplastic elastomers. Of these olefin elastomers, olefin-based block copolymers are desirable. Suitable examples of olefin-based block copolymers are crystalline polyethylene block-bearing thermoplastic elastomers. Preferred use can be made of block copolymers having hard segments composed of crystalline polyethylene blocks (E) or crystalline polyethylene blocks (E) in combination with crystalline polystyrene blocks (S), having soft segments with a relatively random copolymer structure (EB) composed of ethylene and butylene, and having a molecular structure with a hard segment at one or both ends, such as an E-EB, E-EB-E or E-EB-S structure.

These thermoplastic elastomers can be obtained by the hydrogenation of polybutadiene or a styrene-butadiene copolymer. The resilience of the mantle layer can be enhanced even further by using as the mantle layer material a highly neutralized material prepared by adding calcium hydroxide to the ionomer resin.

Referring to FIG. 1, it is recommended that the mantle layer have a radial thickness $t_1$ of at least 0.7 mm but not more than 2.0 mm. Preferably, the mantle layer is formed such that it has a thickness $t_1$ which is about the same as or somewhat greater than the cover thickness $t_2$ described below.

The mantle layer in the golf ball of the invention has a surface Shore D hardness, defined as the surface hardness measured at the surface of a sphere consisting of the elastic solid core and the mantle layer (the same applies to the surface hardness of the cover), in a range of preferably 56 to 68, and most preferably 56 to 66. If the mantle layer is too soft, the spin rate may increase no matter what type of shot is taken, in addition to which the distance traveled by the ball may decrease and the feel of the ball upon impact may become too soft. On the other hand, if the mantle layer is too hard, the spin rate may drop, reducing controllability, the ball may have a hard feel upon impact, and the resistance to cracking with repeated impact may decline.

The cover of the inventive golf ball can be made primarily of a urethane elastomer. Suitable urethane elastomers include thermoplastic and thermoset polyurethane elastomers. A conventional method may be used to form the cover.

The cover has a thickness which, as can be seen in FIG. 1, is the radial distance between the surface of the mantle layer 4 and the surface of the cover 3. "Cover surface," as used herein, refers to land areas 5; that is, those areas on the cover 3 where dimples 2 are not formed. It is recommended that the cover have a thickness $t_2$ which is generally at least 0.7 mm but not more than 1.8 mm.

The cover has a surface Shore D hardness of preferably 51 to 62, and most preferably 54 to 62. If the cover is too soft, the spin rate may increase no matter what type of shot is taken, in addition to which the distance traveled by the ball may decrease and the feel upon impact may become too soft. On the other hand, if the cover is too hard, there is a tendency for the spin rate to drop, reducing controllability, and for the ball to have a hard feel upon impact.

To achieve a good balance in the performance of the mantle layer and the cover, either one may be set to a smaller or larger Shore D hardness, provided the difference in Shore D hardness therebetween is not more than 10, preferably not more than 8, and most preferably not more than 5. As an illustrative example, the cover may be set to a Shore D hardness which is from 1 to 10 units lower than the Shore D hardness of the mantle layer.

The golf ball of the invention has a plurality of dimples on the surface of the cover. The dimples must be optimized in the manner described subsequently. Referring to FIG. 1, the dimples 2 on the golf ball of the invention may be formed as a plurality of dimples of differing diameter and/or depth. For the purpose of the invention, dimples of two or more types generally suffice. The dimple shape is not critical, although it is recommended that dimples which are circular in the planar view have a diameter of at least 2.0 mm, and preferably at least 2.5 mm, but not more than 5.0 mm, and preferably not more than 4.5 mm.

"Dimple diameter," as used herein, refers to the diameter of the planar circle circumscribed by the dimple edge, which is made up of the topmost positions of the dimple connected to the land area 5. In a painted ball, the dimple depth in the painted state is the distance in the radial direction of the ball from the plane of the circle to the deepest portion of the dimple.

No particular limitation is imposed on the total number of dimples on the golf ball of the invention, although it is desirable for the total number to be at least 300, and preferably at least 360, but not more than 550, and preferably not more than 500.

The inventive golf ball has on its surface preferably 300 to 400, and most preferably 330 to 400, large dimples with a diameter of at least 3.7 mm. The presence of fewer than 300 dimples of at least 3.7 mm diameter tends to result in a poor flight by the ball when hit for distance with a club such as a driver. On the other hand, when the ball has more than 400 such dimples, interference between the dimples tends to result in a similarly poor flight.

The total dimple volume arrived at by adding together, for each dimple on the ball's surface, the volume below a planar surface circumscribed by the edge of the dimple is in a range of preferably 280 to 350 $mm^3$. At a total volume of less than 280 $mm^3$, the ball has too high a trajectory when hit with a driver in particular. On the other hand, at a total volume of more than 350 $mm^3$, the ball tends has too low a trajectory.

The dimples may be arranged over the surface of the inventive golf ball in any suitable known configuration, such as a regular icosahedral or regular dodecahedral configuration. It is preferable for the dimples to be distributed in a substantially uniform manner so that the ball has on its surface no more than one great circle that does not intersect any dimples. Such a configuration allows the dimples to be arranged in a high density.

Figure 2:
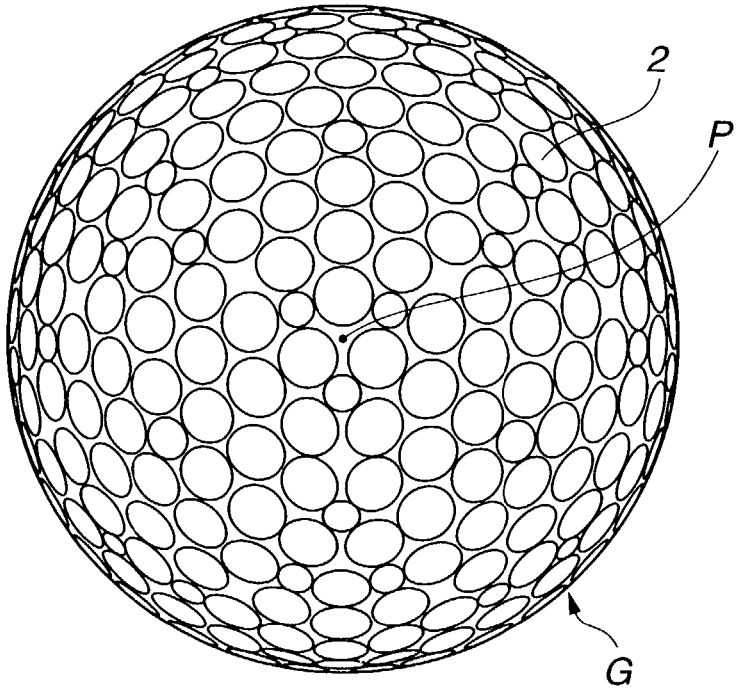
FIG. 2 is a top view showing a golf ball according to one embodiment of the invention, as seen from a polar side thereof.
Figure 3:
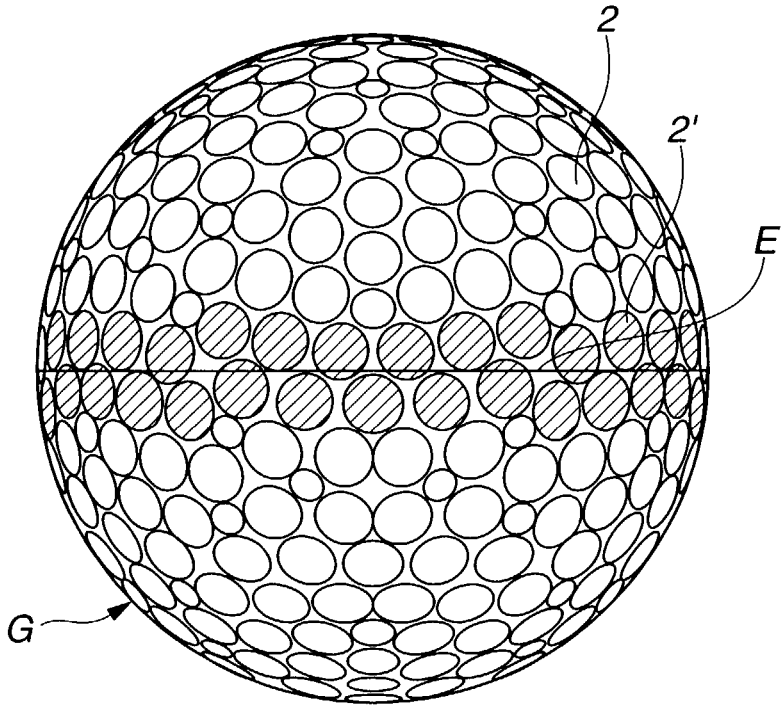
FIG. 3 is a side view of the same embodiment, as seen from the equatorial side.

FIGS. 2 and 3 show an example of a dimple configuration. FIG. 2 is a top view taken from a polar P side, and FIG. 3 is a side view taken from an equatorial E side. FIG. 2 shows a regular icosahedral arrangement of 432 dimples distributed over the surface of the ball. The dimples are of four types having respective diameters of 3.91 mm (300 dimples), 3.82 mm (60 dimples), 2.96 mm (12 dimples) and 2.48 mm (60 dimples). In this example, there is no great circle on the ball's surface which intersects no dimples 2.

In FIG. 3, the dimples 2' (indicated by hatched lines) situated near the ball's equator E are preferably formed to a depth 5 to 60 μm greater than dimples 2 of the same diameter in other areas. As a result, the deeper dimples have a volume that is 2 to 30% larger. One reason why the dimples 2' are formed to a greater than normal depth has to do with the fact that the equator E is located at the parting line between the halves of the ball cover-forming mold. Cover stock flash that solidifies within the mold gates at the position of the parting line on the ball is later removed by buffing, during which process the depth of dimples situated along the equatorial plane may become too shallow. Hence, the need at this location for deeper dimples. It is desirable to form the dimples 2' to a greater depth along the entire periphery of the ball, although it is possible instead to form only every nth (where n is 2 or larger) such dimple 2' to a greater depth. It should be noted that deep dimples 2' are not limited only to positions close to the equator E, and can be formed at any dimple 2 locations within the region extending out from the equator to the latitudes 30° north and 30° south.

FIG. 3 shows an example of a dimple arrangement in which there are no great circles which do not intersect any dimples. The number of dimples which cross the equator E and project out into the other hemisphere (i.e., dimples which intersect the equator) is in a range of preferably 8 to 30 over the periphery of the ball. An amount of such projection which is 10 to 45% the dimple diameter is desirable for ease of operation during manufacture of the golf ball. Such dimple projections correspond to the projecting portions of dimple-forming protrusions within the mold. When a two-part mold is used, the shape of the mold parting line is determined by the projecting shapes of such protrusions.

The golf ball of the invention thus has a highly dense arrangement of dimples on the surface thereof. To provide an enhanced flight performance, the sum of the individual dimple surface areas, each of which is defined as the area of the planar surface circumscribed by the edge of the dimple, expressed as a percentage based on the spherical surface of the ball were it to have no dimples thereon and referred to hereinafter simply as the "dimple surface coverage," is preferably at least 75%, and most preferably 75 to 85%.

It is desirable for the golf ball of the invention to have, as a finished product, a deflection of 2.4 to 3.5 mm when subjected on a flat plate to a load of 1,275 N (130 kgf) from an initial load of 98 N (10 kgf).

It is also desirable for the inventive golf ball to have a coefficient of restitution (COR) of from 0.77 to 0.83 at an incident velocity of 43 m/s. As used herein, "coefficient of restitution" refers to the ratio of the ball's velocity following collision to its velocity before collision (incident velocity) when the golf ball is made to strike a steel plate that does not deform when struck by the ball. The closer this value is to unity, the higher the rebound of the ball.

Preferably, the golf ball of the invention, when hit, has a coefficient of lift CL and a coefficient of drag CD such that the ratio CL/CD is 0.676 to 0.796 at a Reynolds number of 200,000 and a spin rate of 2,700 rpm, 0.813 to 0.933 at a Reynolds number of 120,000 and a spin rate of 2,400 rpm, and 0.856 to 0.976 at a Reynolds number of 80,000 and a spin rate of 2,000 rpm.

That is, obtaining a ball which, when hit with a club designed for long shots (e.g. a driver), has a long distance, and in particular is resistant to wind effects and provides a good run, requires a suitable balance between the forces of lift and drag on the ball that has been hit. This balance is dependent on a number of dimple parameters, including the types and total number of dimples, and the surface coverage and total volume of the dimples.

Figure 4:
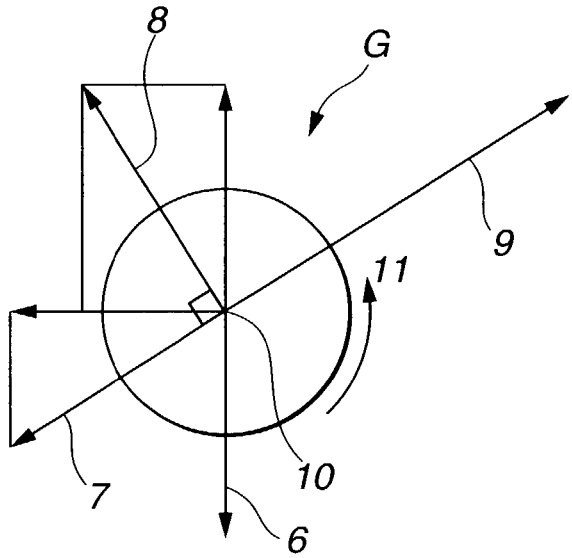
FIG. 4 is a diagram illustrating the relationship between lift and drag forces on the golf ball during flight.

A golf ball G that has been hit with a club and is in flight is known to incur, as shown in FIG. 4, a gravitational force 6, air resistance (drag) 7, and lift 8 on account of the Magnus effect from the ball's spin. Also shown in the diagram are the direction of flight 9, the ball's center 10, and the direction of spin 11 by the ball.

The forces that act on the golf ball in this case are expressed by the following trajectory equation (1)

$$F=FL+FD+Mg \tag{1}$$

wherein F is the sum of the forces acting upon the ball, FL is the lift, FD is the drag, and Mg is the gravity.

The lift FL and drag FD in the above trajectory equation (1) are given by formulas (2) and (3) below.

$$FL=0.5\times CL\times\rho\times A\times V^2 \tag{2}$$

$$FD=0.5\times CD\times\rho\times A\times V^2 \tag{3}$$

In formulas (2) and (3), CL is the coefficient of lift, CD is the coefficient of drag, ρ is the air density, A is the maximum cross-sectional area of the golf ball, and V is the air velocity with respect to the ball.

EXAMPLES

Examples of the invention and comparatives examples are provided below by way of illustration and not by way of limitation.

Examples 1 to 3, Comparative Examples 1 and 2

The solid golf balls in each of these examples and comparative examples had a single-piece rubber core. In Examples 1 to 3 according to the invention, the mantle layer was made of a composition prepared by adding an olefin elastomer to an ionomer resin, whereas in Comparative Examples 1 and 2, the mantle layer was made entirely of an ionomer resin. The cover used in Examples 1 to 3 and Comparative Example 1 was made of a polyurethane elastomer, and the cover used in Comparative Example 2 was made entirely of an ionomer resin.

The dimple arrangement shown in FIGS. 2 and 3 was used in each of these examples. Details concerning the set of dimple types used in each example are shown in Table 1. Test and evaluation results are presented in Table 2.

Each of the above golf balls was tested for feel upon impact. The feel of the ball when hit with a driver (number one wood) was rated as "Good," "Fair" or "Poor" by three highly skilled amateur golfers.

In addition, the spin on an approach shot was rated. The ball being tested was hit at a head speed of 20 m/s with a pitching wedge (loft angle, 46°) mounted on a swing machine, and the spin rate at the time of impact was measured using a high-speed camera.

TABLE 1

| Set | Type | Dimple parameters: Diameter (mm) | Depth (mm) | Number of dimples | | Total volume ($mm^3$) | Surface coverage (%) |
|---|---|---|---|---|---|---|---|
| A | 1 | 3.91 | 0.155 | 300 | 432 | 312 | 81.4 |
| | 2 | 3.82 | 0.153 | 60 | | (0.77%) | |
| | 3 | 2.96 | 0.130 | 12 | | | |
| | 4 | 2.48 | 0.105 | 60 | | | |
| B | 1 | 3.91 | 0.168 | 300 | 432 | 337 | 81.4 |
| | 2 | 3.82 | 0.165 | 60 | | (0.83%) | |
| | 3 | 2.96 | 0.140 | 12 | | | |
| | 4 | 2.48 | 0.105 | 60 | | | |
| C | 1 | 3.91 | 0.135 | 300 | 432 | 274 | 81.4 |
| | 2 | 3.82 | 0.133 | 60 | | (0.67%) | |
| | 3 | 2.96 | 0.115 | 12 | | | |
| | 4 | 2.48 | 0.105 | 60 | | | |

TABLE 1-continued

| Set | Type | Dimple parameters: Diameter (mm) | Depth (mm) | Number of dimples | | Total volume ($mm^3$) | Surface coverage (%) |
|---|---|---|---|---|---|---|---|
| D | 1 | 3.91 | 0.175 | 300 | 432 | 352 | 81.4 |
| | 2 | 3.82 | 0.172 | 60 | | (0.86%) | |
| | 3 | 2.96 | 0.155 | 12 | | | |
| | 4 | 2.48 | 0.115 | 60 | | | |

Note:
Values shown in parentheses under "Total volume" are the total dimple volume expressed as a percentage of the golf ball volume (for a golf ball of the same size without dimples).

TABLE 2

| | Example 1 | Example 2 | Example 3 | Comparative Example 1 | Comparative Example 2 |
|---|---|---|---|---|---|
| Core | | | | | |
| Deflection (mm) | 3.4 | 3.4 | 3.9 | 3.4 | 4.4 |
| Specific gravity | 1.164 | 1.164 | 1.164 | 1.164 | 1.195 |
| Mantle layer | | | | | |
| Thickness (mm) | 1.65 | 1.65 | 1.65 | 1.65 | 1.65 |
| Shore D hardness | 61 | 66 | 59 | 67 | 52 |
| Specific gravity | 0.94 | 0.95 | 0.95 | 0.95 | 1.02 |
| Cover | | | | | |
| Thickness (mm) | 1.5 | 1.5 | 1.5 | 1.5 | 2.1 |
| Shore D hardness | 58 | 59 | 55 | 50 | 66 |
| Difference in hardness with mantle layer | 3 | 7 | 4 | 17 | 15 |
| Specific gravity | 1.08 | 1.08 | 1.19 | 1.19 | 0.99 |
| Dimple set (see Table 1) | A | B | A | A | B |
| Golf ball | | | | | |
| Deflection (mm) | 2.70 | 2.55 | 2.95 | 2.65 | 3.10 |
| COR | 0.790 | 0.795 | 0.785 | 0.792 | 0.787 |
| Test results | | | | | |
| Spin rate (rpm) | 6050 | 5980 | 6320 | 6700 | 5030 |
| Feel on impact | Good | Fair | Good | Fair | Poor |

Notes:
1) The core and golf ball deflections shown are the values obtained when the test specimen was subjected to a load of 1,275 N (130 kgf) from an initial load of 98 N (10 kgf).
2) The coefficient of restitution (COR) is the ratio of the golf ball's velocity following collision to its velocity before collision when the ball was made to collide with a steel plate at an incident velocity of 43 m/s.

It is apparent from the above results that the golf balls in Examples 1 to 3 according to the invention had a good feel and a suitable spin rate (5,500 to 6,500 rpm). By contrast, the golf ball in Comparative Example 1 had an excessive spin rate outside the range of what is appropriate. The golf ball in Comparative Example 2 had a poor feel on impact and too low a spin rate.

Examples 1 and 4, and Comparative Examples 3 and 4

Next, the lift, drag and total distance were measured for golf balls obtained in Examples 1 and 4 according to the invention and Comparative Examples 3 and 4.

The golf ball in Example 1 had the combination shown in Table 2. The golf balls in Example 4 and Comparative Examples 3 and 4 had the respective dimple sets B, C and D (Table 1), aside from which they were made of the same materials and had the same ball construction as in Example 1.

In the tests, a driver (number one wood) mounted on a swing machine was used to hit the balls at an initial velocity of 72 m/s, a launch angle of 10° and a spin of 2,700 rpm. The results are shown in Table 3.

TABLE 3

| Position of ball | Velocity V (m/s) | Spin (rpm) | Reynolds number | | Example 1 (A) | Example 4 (B) | Comparative Example 3 (C) | Comparative Example 4 (D) |
|---|---|---|---|---|---|---|---|---|
| Immediately after impact | 72.0 | 2,700 | 200,000 | CL | 0.161 | 0.157 | 0.166 | 0.152 |
| | | | | CD | 0.218 | 0.225 | 0.215 | 0.237 |
| | | | | CL/CD | 0.736 | 0.698 | 0.772 | 0.641 |
| High point of trajectory | 41.4 | 2,400 | 120,000 | CL | 0.217 | 0.213 | 0.223 | 0.208 |
| | | | | CD | 0.248 | 0.253 | 0.253 | 0.261 |
| | | | | CL/CD | 0.873 | 0.842 | 0.881 | 0.797 |
| Point of lowest velocity | 26.4 | 2,000 | 80,000 | CL | 0.257 | 0.255 | 0.213 | 0.254 |
| | | | | CD | 0.281 | 0.283 | 0.286 | 0.288 |
| | | | | CL/CD | 0.916 | 0.901 | 0.745 | 0.882 |
| Total distance (m) | | | | | 232 | 229 | 226 | 226 |

Notes:
1) The letters A, B, C and D shown in parentheses indicate the dimple set shown in Table 1.
2) "High point of trajectory" refers to the highest point of the golf ball's trajectory visible by eye to an observer standing on the ground. "Point of lowest velocity" refers to substantially the midpoint between the high point of the trajectory and the landing point of the ball.

As described above and demonstrated in the examples, the golf ball of the invention achieves an excellent balance between rebound, spin and feel upon impact, and also has an outstanding total distance.

Japanese Patent Application No. 2001-329273 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed:

1. A golf ball comprising an elastic solid core, a resin cover which encloses the core and has a plurality of surface dimples, and a mantle layer situated between the core and the cover; wherein the cover and the mantle layer have a difference in Shore D hardness therebetween of at most 10, and the dimples have a total volume of 280 to 350 $mm^3$, wherein the ball, when hit, has a coefficient of lift CL and a coefficient of drag CD such that the ratio CL/CD is 0.676 to 0.796 at a Reynolds number of 200,000 and a spin rate of 2,700 rpm, 0.813 to 0.933 at a Reynolds number of 120,000 and a spin rate of 2,400 rpm. and 0.856 to 0.976 at a Reynolds number of 80,000 and a spin rate of 2,000 rpm.

2. The golf ball of claim 1, wherein the dimples have a diameter of 2.0 to 5.0 mm and the total number thereof is from 300 to 550, wherein 300 to 400 dimples which have the diameter of at least 3.7 mm are included.

3. The golf ball of claim 1, wherein the mantle layer has a Shore D hardness of 56 to 68, and the cover has a Shore D hardness of 51 to 62.

4. The golf ball of claim 1, wherein the mantle layer has a Shore D hardness of 56 to 66.

5. The golf ball of claim 1, wherein the cover has a Shore D hardness of 54 to 62.

6. The golf ball of claim 1, wherein the dimples have a surface coverage of at least 75%, based on the total surface of the ball.

7. A golf ball comprising an elastic solid core, a resin cover which encloses the core and has a plurality of surface dimples, and a mantle layer situated between the core and the cover; wherein the elastic solid core undergoes a deflection of 2.8 to 4.2 mm when subjected to a load of 1,275 N (130 kgf) from an initial load of 98 N (10 kgf), the cover is composed primarily of a polyurethane elastomer, the mantle layer is composed of a composition prepared by the addition of an olefin elastomer to an ionomer resin, the cover is set to a Shore D hardness which is from 1 to 10 units lower than the Shore D hardness of the mantle layer, the dimples have a total volume of 280 to 350 $mm^3$, and the dimples situated near the ball's equator which include dimples intersected with the equator are formed to a depth 5 to 60 μm greater than the dimples of the same diameter in other areas.

8. The golf ball of claim 7, which has a coefficient of restitution of 0.77 to 0.83 at an incident velocity of 43 m/s.

9. The golf ball of claim 7, wherein the olefin elastomer includes olefin-based block copolymers, olefin-based random copolymers, and dynamically crosslinked thermoplastic elastomers.

10. The golf ball of claim 7, wherein an amount of a projection of the dimples which cross the equator and project out into the other hemisphere is 10 to 45% of the dimple diameter.

* * * * *